US012667752B1

(12) United States Patent
Mastrangelo

(10) Patent No.: US 12,667,752 B1
(45) Date of Patent: Jun. 30, 2026

(54) YOGA BLOCK WITH ADJUSTABLE HEIGHT

(71) Applicant: Adjustiblox LLC, Villanova, PA (US)

(72) Inventor: Brett Mastrangelo, Villanova, PA (US)

(73) Assignee: Adjustiblox LLC, Villanova, PA (US)

( * ) Notice: Subject to any disclaimer, the term of this patent is extended or adjusted under 35 U.S.C. 154(b) by 0 days.

(21) Appl. No.: 19/209,789

(22) Filed: May 15, 2025

Related U.S. Application Data

(60) Provisional application No. 63/651,588, filed on May 24, 2024.

(51) Int. Cl.
*A63B 21/00* (2006.01)

(52) U.S. Cl.
CPC .... *A63B 21/4037* (2015.10); *A63B 2225/093* (2013.01)

(58) Field of Classification Search
CPC ..... A63B 21/4037; A63B 21/4033; A63B 21/4034; A63B 21/4035
See application file for complete search history.

(56) References Cited

U.S. PATENT DOCUMENTS

| | | | | |
|---|---|---|---|---|
| 7,111,825 | B2 | 9/2006 | Landsberger et al. | |
| 7,318,794 | B2 | 1/2008 | Davies | |
| 8,740,191 | B2 | 6/2014 | Litcher | |
| D733,230 | S | 6/2015 | Mallory | |
| 9,555,309 | B1 * | 1/2017 | LaBar | A63B 21/0724 |
| 9,878,676 | B2 | 1/2018 | Taylor | |
| 10,399,511 | B2 | 9/2019 | Peter | |
| 10,413,772 | B2 | 9/2019 | Zachariadis | |
| 10,555,603 | B2 | 2/2020 | You et al. | |
| 10,617,217 | B1 * | 4/2020 | Razon | A47C 9/002 |
| 11,331,533 | B1 | 5/2022 | Razon | |
| 11,534,653 | B2 | 12/2022 | Constantz et al. | |
| 2012/0313059 | A1 * | 12/2012 | Litcher | B66F 3/22 254/122 |
| 2013/0067649 | A1 * | 3/2013 | Rane | A47K 17/028 4/254 |
| 2015/0137567 | A1 * | 5/2015 | Smith | A61G 5/0858 297/183.1 |

(Continued)

FOREIGN PATENT DOCUMENTS

| | | | | |
|---|---|---|---|---|
| CN | 110693379 A | * | 1/2020 | E03F 5/10 |
| CN | 106742590 B | | 6/2020 | |

(Continued)

OTHER PUBLICATIONS

"Stainless Steel Lab Jack Scissor Stand Platform (4"× 4")", Sucohans Store, AMAZON, Online available at <https://www.amazon.com/Stainless-Steel-Scissor-Stand- Platform/dp/B07T8FM85H/ref=asc_df_B07T8FM85H/?tag=&linkCode=df0&hvadid=366343827267&hvpos=&hvnetw=g&hvrand=17667553434852041033&hvpone=&hvptwo=&hvqmt=&hvdev=c&hvdvcmdl=&hvlocint=&hvlocphy=9002001&hvtargid=pla-.

*Primary Examiner* — Joshua T Kennedy
(74) *Attorney, Agent, or Firm* — Dilworth IP, LLC

(57) ABSTRACT

The invention relates to an adjustable yoga block designed to enhance user customization and comfort during exercise. The yoga block features a scissor mechanism, movable by manual or motorized means, which allows for precise height adjustments via a user interface with buttons and a real-time height display. The block consists of two main panels connected by adjustable elements that can alter the distance between the panels, thus changing the block's height to accommodate various exercise needs or user preferences.

17 Claims, 4 Drawing Sheets

(56) References Cited

U.S. PATENT DOCUMENTS

| | | | | |
|---|---|---|---|---|
| 2018/0304114 | A1 | 10/2018 | Feinstein | |
| 2020/0187660 | A1 * | 6/2020 | Leia | A47C 7/0213 |
| 2022/0081923 | A1 | 3/2022 | Wankewycz | |

FOREIGN PATENT DOCUMENTS

| | | | | |
|---|---|---|---|---|
| CN | 112320667 | A | 2/2021 | |
| CN | 112125211 | B | 3/2022 | |
| WO | WO-2024238338 | A2 * | 11/2024 | A63B 23/0405 |

* cited by examiner

400

YOGA BLOCK WITH ADJUSTABLE HEIGHT

CROSS-REFERENCES

This application claims the benefit of U.S. Provisional Application No. 63/651,588, filed on May 24, 2024, the contents of which are hereby incorporated by reference in their entirety for all purposes.

TECHNICAL FIELD

The present disclosure relates to the field of fitness and exercise equipment.

BACKGROUND OF THE INVENTION

Yoga blocks are a type of commonly used equipment for performing yoga movements. Yoga blocks of different heights may be used for different exercise needs or for yogis with different body sizes.

SUMMARY OF THE INVENTION

In the present embodiment, the yoga block may include a first panel and a second panel, as well as a scissor mechanism in between to adjust the distance between the first panel and the second panel. The scissor mechanism is implemented by the upper and lower guide tracks and a plurality of bars. Wherein, a first end of each of the plurality of bars may be fixedly connected to the first or the second panel. Wherein, a second end of each of the plurality of bars may connect to the guide rod such that the guide rod may move along the guide tracks.

When the guide rod moves along the upper and lower guide tracks, the distance between the first or second panel may be increased or decreased accordingly. One or more motors may drive the guide rods so that they may move along the upper and lower guide tracks in either direction, which may, in turn, adjust the distance between the first and the second panels in a stepless manner. The adjustment is stepless which allows for continuous variation in height without being limited to predefined, discrete increments or stops.

The motor may be controlled by buttons, for example a pair of buttons, which may respectively increase or decrease the height of the yoga block. Wherein, the height of the yoga block may be displayed on a screen, for example an LED screen.

A battery that powers the one or more motors may be integrated into the yoga block. Wherein, the battery may be rechargeable or non-rechargeable.

A stretchable cover, for example a spandex or spandex-based material, may be used to connect the first and the second panels, forming the four side surfaces of the yoga block. In the present embodiment, the stretchable cover may cover up the horizontal slot and the plurality of bars. The LED screen and the pair of buttons may be integrated into the first panel.

In operation, the user may press buttons, for example an up and down button, to activate a motor that drives an actuator nut along a lead screw. This action moves the scissor mechanism to adjust the block's height, with real-time feedback shown on the display.

In another embodiment, the yoga block may include a horizontal rod in the middle connected to a scissor mechanism, implemented as a plurality of interconnected and moveable bars. The horizontal rod can be spun manually by a knob, and the rod may trigger the scissor mechanism, which may, in turn, increase or decrease the height of the block.

The yoga block may include a first panel and a second panel. The first panel and the second panel may respectively form a top surface and a bottom surface of the yoga block. In some embodiments, the first panel and the second panel may both be rectangular and identical in size and shape.

In some embodiments, the first panel and the second panel may be padded with foam or other soft or impact-absorbing materials. The first panel and the second panel may be connected by a scissor mechanism, which may be implemented as a plurality of bars and a horizontal rod. Wherein, the scissor mechanism may adjust the distance between the first panel and the second panel, which is the height of the yoga block.

The scissor mechanism is made of a load-bearing metal such as steel and may include a horizontal rod in between the first panel and the second panel. The horizontal rod may be able to rotate about its central axis. In some embodiments, a knob may connect to one end of the horizontal rod. When a user turns the knob in either direction, the horizontal rod may spin in either direction accordingly.

The horizontal rod may connect to a plurality of bars. Wherein, a first end of each of the plurality of bars is fixedly connected to the first or second panel. A second end of each of the plurality of bars is connected to the horizontal rod such that the second ends of the bars may move along the horizontal slot. When the second ends of the plurality of bars move along the horizontal slot, the distance between the horizontal rod and the first or second panel may be increased or decreased accordingly. This function is realized by screw connections. In some embodiments, the screw connections are realized by including a plurality of threads on the surface of the horizontal rod, as well as matching threads on a nut-like structure attached to the second end of each of the plurality of bars. This is so that when the user spins the horizontal rod in either direction, the second end of each of the plurality of bars may move along the horizontal slot, which, in turn, may adjust the distance between the first and the second panels.

In some embodiments, a stretchable cover may be used to connect the first and the second panels, forming the four side surfaces of the yoga block. The horizontal rod and the bars of the scissor mechanism may be covered by the stretchable cover, leaving only the knob exposed for ease of operation by the user.

In operation, the user may adjust the height of the yoga block by rotating a knob mechanically coupled to a threaded rod. The rotation may drive nut-like connectors that slide the scissor bars along the rod, expanding or contracting the scissor mechanism which increases or decreases the height of the yoga block by increasing or decreasing the distance between the first and second panel.

BRIEF DESCRIPTION OF DRAWINGS

The present disclosure is further shown by an illustration of the present embodiment, which is described in detail through the accompanying drawings. The drawings of the present embodiment are not limiting, and in these drawings, the same numbering indicates the same structure, wherein.

DETAILED DESCRIPTION

Figure 1:
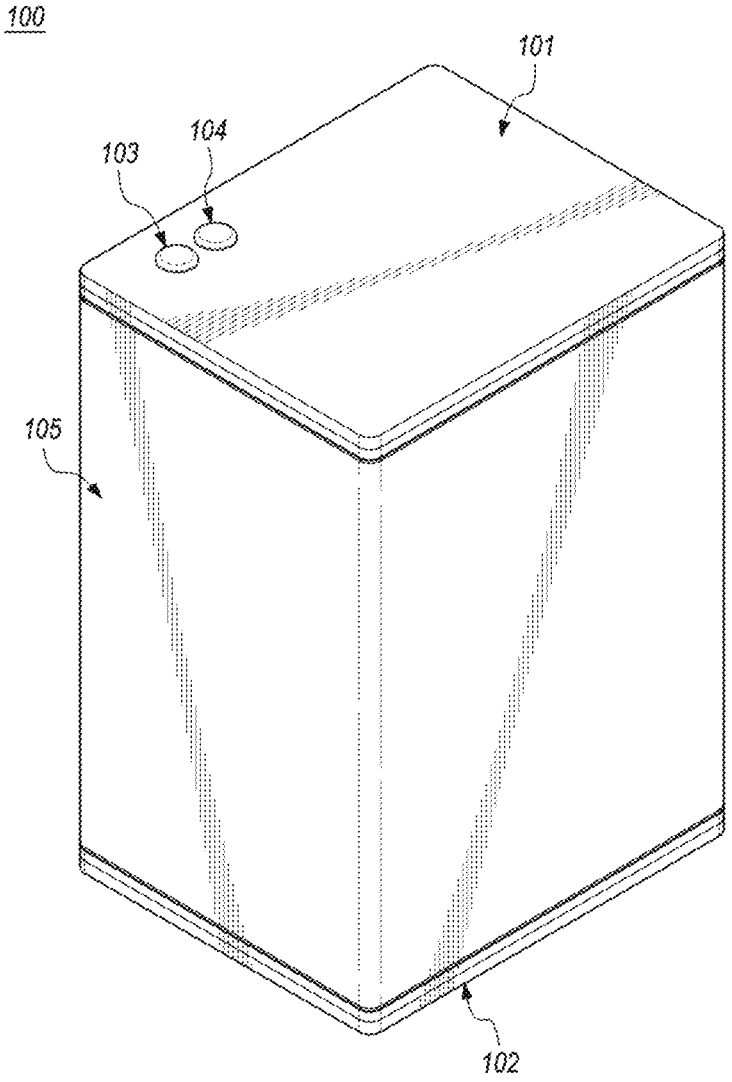
FIG. 1 is an embodiment of the outside of a yoga block with adjustable height

FIG. 1 illustrates the external view of the yoga block in its covered state 100, representing the present embodiment. The yoga block includes a first panel 101 and a second panel 102, which form the top and bottom surfaces, respectively. The panels are connected by a stretchable cover 105 that forms the four sides of the block. Integrated into the first panel is the control interface 103 which consists of buttons that raise or depress the height of the first panel 101. Adjacent to the control interface 103 is the screen 104 which displays the height of the yoga block.

Figure 2:
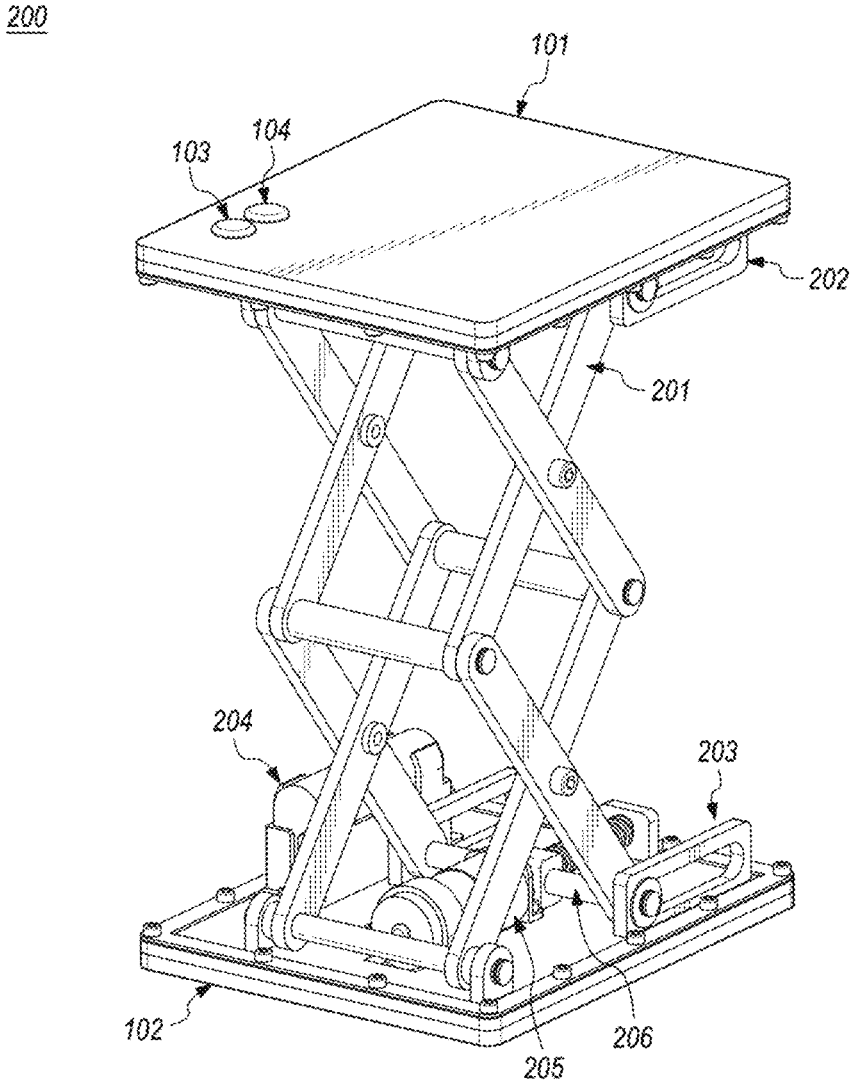
FIGS. 2 and 3 are embodiments of the outstretched internal structure of a yoga block with adjustable height.
Figure 3:
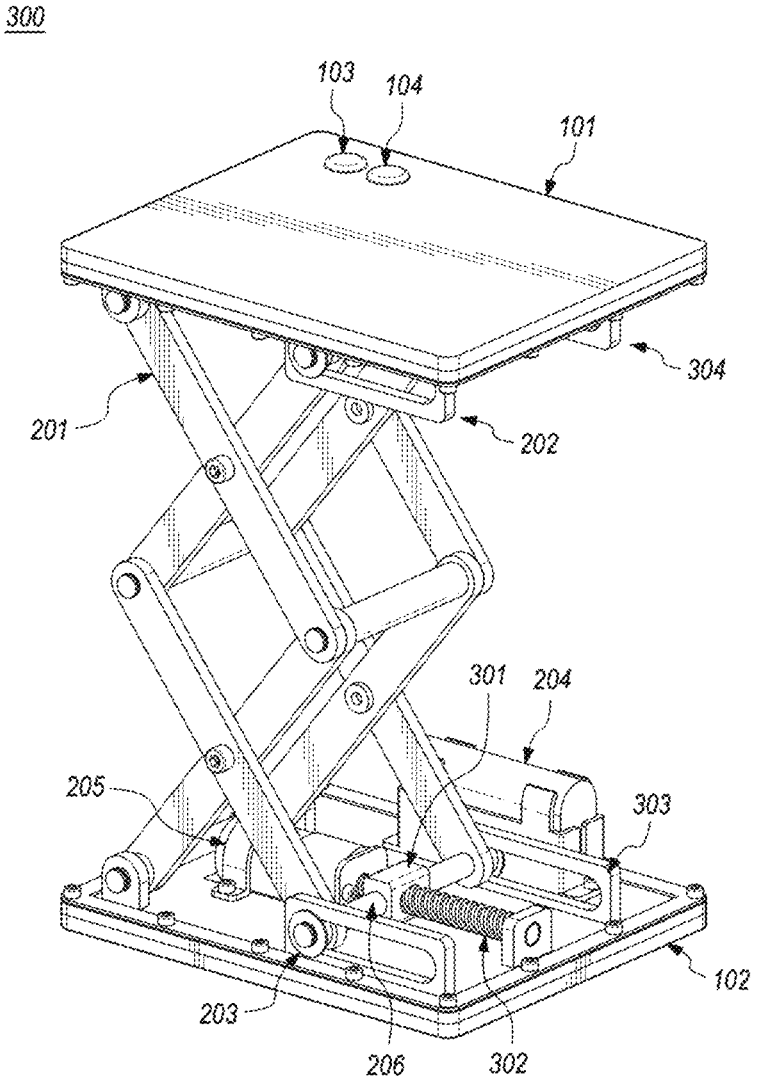
Figure 4:
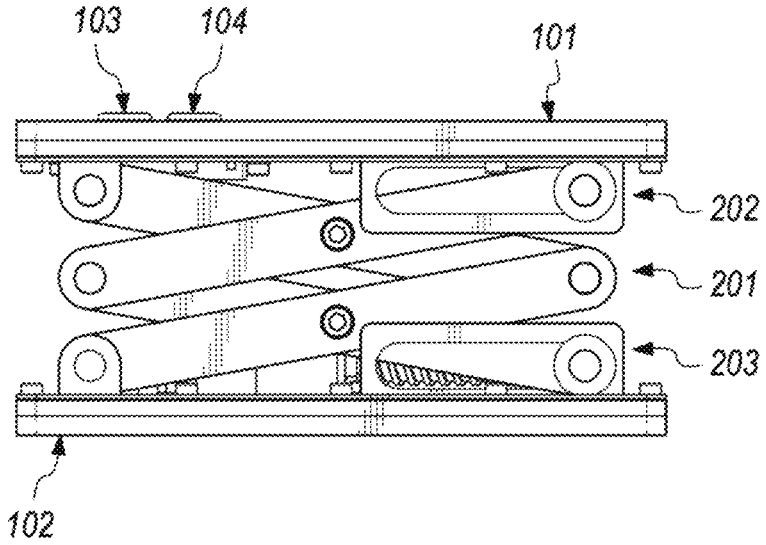
FIG. 4 is an embodiment of the depressed internal structure of a yoga block with adjustable height

FIGS. 2, 3, and 4 illustrate the internal structure of the yoga block without the stretchable cover 105. FIG. 2 presents the yoga block from a front view 200 with the scissor mechanism 201 extended. FIG. 3. presents the yoga block from a back view 300 with the scissor mechanism 201 extended. FIG. 4 presents the yoga block from a side view 400 with the scissor mechanism 201 depressed.

The scissor mechanism 201 comprises a plurality of pivotally connected bars configured to extend or contract vertically between the first panel 101 and the second panel 102. The bars are supported by the guide rod 206 that moves along a system of upper and lower guide tracks (202, 203, 303, 304). Movement along the guide rod 206 ensures stable and coordinated adjustment of the scissor mechanism 201.

The guide rod 206 is connected to an actuator nut 301, which is driven along a lead screw 302 by an electric motor 205 which is powered by a battery 204. When activated, the motor 205 activates the lead screw 302, causing the actuator nut to travel along the lead screw 302 thus moving the guide rod 206 along the system of guide tracks (202, 203, 303, 304) which expands or contracts the scissor mechanism 201.

The motor 205 is controlled by the user through the control interface 103. The control interface 103 can have two buttons, one that upon pressing will extend the scissor mechanism 201 and raise the height of the first panel 101, the second button that will depress the scissor mechanism 201 and lower the height of the first panel 101. The screen 104 adjacent to the control interface 103 displays the real-time height of the yoga block.

The stretchable cover 105 encases the scissor mechanism 201 and internal components, expanding or contracting in sync with the adjustment to the first panel 101. The stretchable cover 105 may be composed of materials such as spandex or similar elastic fabric, and may include antimicrobial or anti-slip treatments.

The scissor mechanism 201 may be composed of steel, aluminum, carbon fiber, or other composites or metals, depending on the weight and durability requirements for the given embodiment. The battery 204 may differ in type, including but not limited to lithium-ion or alkaline cells. The battery 204 may be charged by any conventional charging method, including but not limited to USB A and USB C.

The first panel 101 and the second panel 102 are rectangular, and in the present embodiment they are six inches in length, and three inches in width.

The height of the yoga block is controlled by the control interface 103 and displayed on the screen 104. The screen 104 may be an LED based screen, or any other screen capable of displaying numerations. The maximum and minimum height of the yoga block, the distance between the first panel 101 and the second panel 102 can vary from the floor to two feet. In the present embodiment, the minimum height of the first panel is three inches, and the max height is nine inches.

To use the present embodiment of the motorized yoga block, the user places it on a level surface with the first panel 101 facing up. Pressing the up button on the control interface 103 activates the motor 205 which extends the scissor mechanism 201 and raises the first panel 101. Pressing the down button on the control interface 103 depresses the scissor mechanism 201 and lowers the first panel 101. The screen 104 provides the height measurement to ensure consistent settings across different poses or sessions.

The screen 104 provides real-time feedback on the block's current height, which is particularly helpful in shared practice spaces, group classes, or rehabilitative settings where consistency is important. Users can also memorize preferred height levels for specific poses and return to them quickly.

This embodiment allows for precise and consistent adjustments without requiring manual effort. Users with limited mobility, reduced hand strength, or specific therapeutic needs may benefit greatly from the powered adjustment. Adjustments can be made between poses with minimal disruption to flow, and the block remains stable.

Although the figures only illustrate the motorized embodiment, the invention is not limited to this implementation. The manual adjustment embodiment herein is fully contemplated below and may be preferred in cases where simplicity, cost, or power-independence is prioritized.

In another embodiment, the control interface may be capacitive touch buttons or be replaced entirely with a wireless control system, such as a Bluetooth-enabled app. The screen may also be upgraded with additional sensors or integrated into a mobile device display.

An embodiment with a motor may also contain a knob for manual adjustment in case of power failure. In this embodiment, the stretchable cover could be removable as to access the knob, or the stretchable cover could have an opening in which the knob extends through and is accessible outside of the stretchable cover.

The control interface may extend beyond physical buttons. For example, voice control functionality may be added using built-in microphones or wireless pairing with voice assistants through Bluetooth or Wi-Fi. Additionally, a mobile application may provide remote control and customizable presets for height levels associated with specific yoga poses or user preferences.

To improve structural performance, some embodiments may include a dual-lead screw design where two actuator nuts are driven in parallel to evenly distribute load.

Some embodiments may be designed specifically for outdoor or high-moisture environments. These embodiments may include components such as sealed motor housings, waterproof materials, and rubberized external panels. Additionally, a detachable battery module may allow users to swap power units quickly or charge them independently from the block.

In another embodiment, the yoga block is adjusted manually using a threaded rod mechanism. This version omits the motor, battery, and control electronics. Instead, a knob is attached to one end of a threaded horizontal rod positioned centrally within the yoga block.

The scissor mechanism in this embodiment includes a plurality of pivotally connected bars, with each bar having a first end fixed to either the top or bottom panel and a second end coupled to a nut-like structure that engaged with the threaded rod. When the user rotates the knob, the threaded rod turns, causing the nut-like structures and the second ends of the bars to translate along the rod. This motion adjusts the spacing between the panels and changes the height of the yoga block. The knob would extend through an opening in the stretchable cover.

The rotation of the knob can be finely controlled by the user, allowing for incremental and secure adjustment of the block's height. No locking mechanism is required, as the threaded engagement between the rod and the nut-like structures inherently resists displacement under the load.

In another embodiment, the knob may be placed at either end of the threaded rod or may include dual knobs on both ends for ambidextrous operation.

In another embodiment, the yoga block could include modular accessories such as side handles.

The knob may also be designed in different forms, including a foldable crank handle. In some embodiments, a visual feedback system may be included to indicate set height levels such as markings on the structure of the yoga block.

To use the manual adjustment embodiment of the yoga block, the user places it on a surface and turns the knob to raise or lower the block. Turning the knob clockwise extends the scissor mechanism, increasing the height of the yoga block. Turning the knob clockwise depresses the scissor mechanism, decreasing the height of the yoga block. The user may adjust the block before, during, or after a yoga session depending on the desired posture or level of support.

Adjusting the height allows the user to customize the block height for a variety of yoga poses. For example, a higher block setting can provide additional support in standing forward folds, triangle pose, or lunges, helping to bridge the gap between the floor and user. A lower setting can assist with seated postures where a more grounded base is desired.

The user can visually inspect or physically gauge the height level as the block adjusts. Once the desired height is reached, the internal friction and threading securely hold the position without the need for locking mechanisms. The mechanical simplicity of the design makes this embodiment especially intuitive and reliable, especially in environments where electronic systems are less desirable or where portability and minimal weight are prioritized.

The above-referenced descriptions are illustrative of the present invention and examples of alternative embodiments. Numerous modifications and alternative arrangements can be devised without departing from the spirit and scope of the invention. The drawings can be treated as independent embodiments of the present invention. Various elements of the disclosed embodiments may be reworked and integrated with each other or used in combination. Those skilled in the art will readily recognize various adaptations which can be made to the invention which will result in an improved mobility device, yet all will fall within the scope and spirit of the present invention as defined in the following claims.

The invention claimed is:

1. A yoga block with adjustable height, comprising:

a first panel and a second panel, each forming a top surface and a bottom surface of the yoga block, respectively;

a scissor mechanism, positioned between the first panel and the second panel, the scissor mechanism comprising;

horizontal slots associated with the first panel and the second panel; and two sets of pivotably connected bars, where:

a first of the two sets of pivotably connected bars is fixedly connected to each of the first and second panels; and a second of the two sets of pivotably connected bars slidably coupled to each of the horizontal slots;

a motor, operatively connected to the plurality of bars, configured to move the second of the two sets of the pivotably connected bars along each of the horizontal slots;

a stretchable cover surrounding the scissor mechanism, wherein the stretchable cover forms four side surfaces of the yoga block;

a control interface positioned on the first panel, comprising at least one pair of buttons, wherein activation of the buttons causes the motor to increase or decrease the height of the yoga block in a stepless adjustment; and a power source, supplying power to the motor.

2. The yoga block of claim 1, wherein the power source is a rechargeable battery integrated within the yoga block.

3. The yoga block of claim 1, wherein the motor is controlled by an electronic circuit configured to regulate the movement speed and stopping points of the scissor mechanism.

4. The yoga block of claim 1, further comprising an LED display, configured to show the current height of the yoga block in real time.

5. The yoga block of claim 1, wherein the scissor mechanism comprises a lead screw and an actuator nut, the actuator nut configured to move along the lead screw when driven by the motor.

6. The yoga block of claim 1, wherein the horizontal slots includes a pair of parallel guide tracks on opposing sides of the yoga block.

7. The yoga block of claim 1, wherein the plurality of bars are made of steel or other metal.

8. The yoga block of claim 1, wherein the first and second panels are padded with foam or another impact-absorbing material.

9. The yoga block of claim 1, wherein the first panel and the second panel are rectangular.

10. The yoga block of claim 1, wherein the first panel and the second panel are identical in size and shape.

11. A method of using the yoga block with adjustable height of claim 1, comprising:

placing the yoga block on a surface;

activating the motor by pressing a first button of the at least one pair of buttons to increase a height of the yoga block or a second button of the at least one pair of buttons to decrease the height;

adjusting a distance between the first panel and the second panel according to the button input as the motor moves the second of the two sets of pivotably connected bars within each of the horizontal slots in a stepless manner; and using the yoga block at the selected height to support a user to perform yoga movements.

12. The method of claim 11, further comprising recharging the integrated battery of the yoga block when the power source is depleted.

13. The method of claim 11, wherein adjusting the height further comprising regulating movement using an electronic circuit, ensuring smooth transitions between different height levels.

14. The method of claim 11, further comprising the current height on an LED display.

15. The method of claim 11, further comprising monitoring battery level through an LED indicator on the block.

16. The method of claim 11, wherein the first panel and the second panel are rectangular.

17. The method of claim 11, wherein the first panel and the second panel are identical in size and shape.

* * * * *